United States Patent [19]

Bay et al.

[11] Patent Number: 4,931,062

[45] Date of Patent: Jun. 5, 1990

[54] HYDROPHOBIZATION OF LEATHER, PELTS AND LEATHER SUBSTITUTE MATERIALS WITH CARBOXYL-CONTAINING POLYSILOXANES

[75] Inventors: Herbert Bay, Reutlingen; Guenter Eckert, Limburgerhof; Wolfram Bergold, Heidelberg, all of Fed. Rep. of Germany

[73] Assignee: Basf Aktiengesellschaft, Ludwigshafen, Fed. Rep. of Germany

[21] Appl. No.: 295,392

[22] Filed: Jan. 10, 1989

[30] Foreign Application Priority Data

Jan. 12, 1988 [DE] Fed. Rep. of Germany ..... 3800629

[51] Int. Cl.[5] ..... C14C 5/00; C14C 1/00; C14C 9/00

[52] U.S. Cl. ..... 8/94.23; 8/94.1 R; 8/94.21; 427/379; 427/387

[58] Field of Search ..... 8/94.1 R, 94.18, 94.23; 106/287.12; 427/379, 387

[56] References Cited

U.S. PATENT DOCUMENTS

| | | | |
|---|---|---|---|
| 3,116,965 | 1/1964 | Ender | 8/94.23 |
| 4,501,619 | 2/1985 | Gee | 106/287.12 |
| 4,701,269 | 10/1987 | Bay et al. | 8/94.1 R |

FOREIGN PATENT DOCUMENTS 3529869 2/1987 Fed. Rep. of Germany .

*Primary Examiner*—Paul Lieberman
*Assistant Examiner*—John F. McNally
*Attorney, Agent, or Firm*—Oblon, Spivak, McClelland, Maier & Neustadt

[57] ABSTRACT

Leather, pelts and leather substitute materials are hydrophobized with a carboxyl-containing polysiloxane whose carboxyl groups are present in neutralized form in an aqueous phase in the absence of emulsifiers and without aftertreatment with mineral tanning agents.

6 Claims, No Drawings

HYDROPHOBIZATION OF LEATHER, PELTS AND LEATHER SUBSTITUTE MATERIALS WITH CARBOXYL-CONTAINING POLYSILOXANES

The present invention relates to a process for hydrophobizing leather, pelts and leather substitute materials with a carboxyl-containing polysiloxane whose carboxyl groups are present in neutralized form by application from an aqueous phase in the absence of emulsifiers and without aftertreatment with mineral tanning agents.

Various methods for hydrophobizing leather, pelts and leather substitute materials are known, for example methods where high molecular weight water-insoluble substances, such as paraffins, waxes, esters, polysiloxanes, natural and synthetic fat substances or fatty acid condensation products, are emulsified with emulsifiers suitable for salt formation and incorporated into the leather in an aqueous medium. The emulsifiers used are subsequently made largely ineffective by lowering the pH in the treatment liquor and subsequently treating the leathers with mineral tanning agents, such as chromium(III) salts, aluminum salts or zirconium salts. This necessitates an appreciable additional time requirement, since the entire leather cross-section must be penetrated by the fixative. Furthermore, undesirable residues of the metal salts used appear in the waste water. Also, accurate shade standardization is difficult in practice, since the strongly cationic action of the metal salts and their self-color can lead to changes in color.

It is also known to hydrophobize leather, pelts and leather substitute materials with, for example, polysiloxanes, fluorocarbon resins, aluminum soaps or water-in-oil emulsifiers suitable for hydrophobization. These products are always applied in the form of solutions in organic solvents, for example white spirits or chlorinated hydrocarbons. The disadvantage of working with these solvents is the danger to health and environment and the fire hazard posed by white spirits. Besides, the treatment of leather with products dissolved in organic solvents is an additional substantial drain on labor resources.

German Laid-Open Application DOS 3,529,869 describes a process for hydrophobizing leather and pelts with a silicone oil in the presence of a salt of an N-($C_9$–$C_{20}$-acyl)amino acid, for example oleoyl sarcoside or Medialan acid, as an emulsifier, where the aqueous emulsion of a silicone oil is allowed to act on the leathers or pelts at a pH of from 4.5 to 8.0 in the presence of the abovementioned emulsifiers in an aqueous liquor, the pH is then adjusted to from 3.0 to 5.0, and to obtain favorable results an aftertreatment must be carried out with a 2-, 3- or 4-valent metal salt. The silicone oils suitable for this process are those which are commercially available with viscosities of from 30 to 1,000 mPa.s, preferably from 80 to 500 mPa.s. Silicone oils of this type may be found for example in Römpps Chemie-Lexikon 7th edition, Stuttgart, 1975, pages 3223 et seq. or Ullmanns Enzyklopädie der techn. Chemie, 4th edition, 1982, volume 21, pages 512 et seq.. The stated viscosities here are a practical measure of the molecular weights which can frequently only be determined at great expense.

Preferred silicone oils for this process are dimethylpolysiloxanes having a viscosity of 80 to 100 mPa.s, phenylmethylpolysiloxanes having a viscosity of from 85 to 120 mPa.s, dimethylpolysiloxanes having amino groups as reactive groups, characterized by an amine number of about 0.8–1.0, and a viscosity of from 30 to 50 mPa.s, and also dimethylpolysiloxanes having carboxyl groups as reactive groups, particularly having an average from 2 to 10 carboxyl groups per molecule. Of these, dimethylpolysiloxanes whose methyl groups have been partly replaced by mercaptopropyl or aminopropyl groups as reactive groups are very particularly preferred.

It is an object of the present invention to provide a process for hydrophobizing leather, pelts and leather substitute materials which can be carried out in an aqueous liquor and which makes it possible to dispense with the use of emulsifiers and an aftertreatment with metal salts, in particular chromium(III) salts.

We have found that this object is achieved with a process for hydrophobizing with a carboxyl-containing polysiloxane whose carboxyl groups are present in neutralized form. By means of these specific polysiloxanes, the salts of which can be self-emulsifying or soluble in water, it is possible to obtain results at least equivalent to those of the prior art without the presence of emulsifiers and without an aftertreatment with metal salts, since these polysiloxanes are easily incorporable into the leather in an unforeseeable manner. Organic solvents, in particular hydrocarbons, can be dispensed with.

The process of the invention is notable for simplicity, timesaving and occupational and ecological hygiene. Customary assistants for producing the emulsions or solutions are not necessary.

The present invention accordingly provides a process for hydrophobizing leather, a pelt or a leather substitute material with a carboxyl-containing polysiloxane whose carboxyl groups are present in neutralized form by treating the leather or pelt before, during or after retanning with the neutralized polysiloxane in an amount of 0.1 to 15% by weight, preferably from 0.2 to 10% by weight, based on the shaved weight of the leather or the wet weight of the pelts, in an aqueous liquor at a pH of from 4.0 to 8.0, preferably of from 5.0 to 6.0, and then adjusting the pH to from 3.0 to 5.0, preferably to from 3.5 to 4.5.

The carboxyl-containing polysiloxanes used in the process according to the invention are known per se to the person skilled in the art. It is particularly advantageous to use polysiloxanes where the residual valences of the silicon are saturated by hydrocarbon radicals, in particular methyl but also ethyl, propyl or phenyl, and which contain from their preparation carboxyl or preferably carboxylic anhydride groups incorporated in the molecule via these hydrocarbon radicals in a terminal and/or side chain position Particular preference is given to dimethylpolysiloxanes and methylpropylpolysiloxanes having terminal carboxylic anhydride groups. They can be characterized in terms of their anhydride numbers of from 0.2 to 1.7, preferably of from 0.4 to 0.8. The molecular weights of polysiloxanes having anhydride groups are conveniently described in terms of the viscosity ranges of from 100 to 500 mPa.s, preferably from 150 to 220 mPa.s (each determined at 25° C. in an Ubbelohde viscometer). The length of the siloxane chain, i.e. the number of $(SiO)_n$ units, may be specified as $n = 10$–$120$, preferably $n = 20$–$40$.

To neutralize carboxyl groups present or to hydrolyze and neutralize anhydride groups present, the polysiloxanes are advantageously standardized in aqueous solution with the corresponding amount of alkali (for example sodium hydroxide or potassium hydroxide), ammonia, a saturated organic amine, alkanolamine or an aminocarboxylic acid to a pH of from 7 to 10, preferably from 7.5 to 8.5. The carboxylic anhydride groups can initially also be converted with alcohols to the halfester and the free carboxyl group is then subsequently neutralized.

Suitable salts are alkali metal salts, in particular of sodium or potassium, ammonium salts, or amine salts, in particular those of morpholine and alkanolamine salts in particular those of mono-, di- or trialkanolamines of from 2 to 6 carbon atoms in the alkanol radical, such as mono-, di- or triethanolamine. It is also possible to neutralize the carboxyl groups with aminocarboxylic acids of from 2 to 6 carbon atoms in total, for example sarcosine. The reaction of anhydrido-containing polysiloxanes, in particular polysiloxanes which contain a maleic anhydride or succinic anhydride end group, with amines gives rise to the corresponding halfamides. Preferred amines are morpholine and sarcosine. Anhydrido-containing polysiloxanes can also be reacted with alcohols, for example monohydric $C_1$–$C_8$-alcohols, such as methanol, ethanol, n-propanol, isopropanol, n-butanol, isobutanol, n-hexanol, n-octanol, isooctanol or 2-ethylhexanol, to give the corresponding half-ester groups. Even polyhydric alcohols, such as glycol or glycerol, can react with the carboxylic anhydride end groups of the polysiloxanes to give the corresponding half-esters.

The hydrolysis of the anhydride groups with the bases required to complete neutralization takes place in water without any problem.

For practical use in the hydrophobization, it is advantageous to prepare aqueous emulsions having concentrations of from 5 to 90, preferably from 20 to 50, % by weight, as revealed in the Examples, and added to the treatment liquor. The aqueous emulsions obtained are surprisingly stable, so that no additional assistants need be used.

In certain circumstances, solvent/water mixtures with a lower alcohol, such as isopropanol/water, ethanol/water or methoxypropanol/water, are useful, for example when dry leather is to be subsequently hydrophobized.

The present invention also provides a method of using carboxyl-containing polysiloxanes whose carboxyl groups are present in the above-specified neutralized form for hydrophobizing leather, pelts and leather substitute materials in an aqueous liquor before, during or after retanning without the use of emulsifiers.

The actual hydrophobization according to the invention is effected before, during or after retanning by drumming in a suitable apparatus in a conventional manner, i.e. at liquor lengths of from 10 to 2000%, preferably from 50 to 200%, based on the shaved weight of the leather or the wet weight of the pelt, relatively high liquor lengths being used for pelts, at from 20 to 60° C., preferably at from 30 to 50° C., at the start the pH being from 4.0 to 8.0, preferably from 5.0 to 6.0. The time required is within the range from 20 to 180 minutes, preferably from 30 to 90 minutes. At the end of the hydrophobization the pH is adjusted to from 3.0 to 5.0, preferably to from 3.5 to 4.5, in particular to from 3.5 to 3.9, preferably by the addition of formic acid, for the customary fixation of the tanning agents, dyes and any other tanning assistants used.

It may additionally be mentioned that the hydrophobizing process according to the invention is advantageously combinable with conventional hydrophobizing agents for leather and pelts as known to the person skilled in the art for example on the basis of a paraffin or wax emulsion.

The hydrophobization according to the invention may also be carried out in multiple stages proportionately before, during or after the actual retanning, as is illustrated in Application Examples b and c. Advantageous starting leathers are mineral tanned leathers. The retanning agents used may be the vegetable tanning agents and synthetic tanning agents based on phenol- and/or naphthalenesulfonic acid/formaldehyde condensates, polymer tanning agents based on for example acrylates or methacrylates, aldehyde tanning agents or resin tanning agents based for example on melamine-urea or dicyanodiamide-formaldehyde condensates which are customarily used in leathermaking. Suitable dyes are the acid, direct or basic aniline dyes customary in the art.

EXAMPLES

Parts and percentages are by weight, unless otherwise stated. The viscosities were measured with an Ubbelohde viscometer at 25° C.

A. Preparation of polysiloxane emulsions to be used according to the invention

EXAMPLE 1

100 parts of a dimethylpolysiloxane having carboxylic anhydride groups, an anhydride number of 0.65 and a viscosity of 190 mPa.s are mixed with 17.5 parts of morpholine (100% pure) with stirring, 400 parts of water at 30° C. are slowly added with stirring, and the mixture is then homogenized. The resulting finely divided, stable, approximately 20% strength emulsion has a pH of 8.5.

EXAMPLE 2

100 parts of a dimethylpolysiloxane having carboxylic anhydride groups, an anhydride number of 0.45 and a viscosity of 208 mPa.s are admixed with 50 parts of water at 20° C., followed by 85 parts of 10% strength aqueous ammonia with stirring. A further 265 parts of water at 30° C. are then stirred in, and the resulting emulsion is homogenized. The emulsion has a pH value of 8.35.

EXAMPLE 3

100 parts of a methylpropylpolysiloxane having carboxylic anhydride groups, an anhydride number of 0.75 and a viscosity of 172 mPa.s are gradually admixed with 205 parts of 10% strength aqueous diethanolamine with stirring. A further 195 parts of water at 30° C. are then stirred in, and the resulting emulsion is then homogenized. The ready-produced emulsion has a pH of 8.6.

EXAMPLE 4

100 parts of a dimethylpolysiloxane having carboxylic acid anhydride groups, an anhydride number of 0.6 and a viscosity of 160 mPa.s are admixed with 50 parts of water at 20° C., followed by 60 parts of 1 N sodium hydroxide solution added slowly with stirring. A further 290 parts of water at 30° C. are then added with stirring, and the resulting emulsion of pH 8.5 is homogenized.

B. Application Examples

In the Application Examples that follow, the drumming takes place at 40° C.

Application Example a:

Wetblue leather pieces 2 mm in shaved thickness which have been neutralized to pH 5 are drummed for 60 minutes in the presence of 5% by weight of commercially available mimosa extract, 5% by weight of a commercially available synthetic tanning agent based on phenolsulfonic acid/formaldehyde condensate and 1% by weight of a commercially available aniline dye, all the percentages being based on the shaved weight.

This is followed by drumming for 60 minutes with 10% by weight of the polysiloxane emulsion specified in Example 1, and the working liquor at 100% length is soured off with formic acid to a pH of 3.8.

The pieces of leather are then washed, mechanically set out and dried. The pieces of leather obtained are soft and supple and have a pleasant handle and an excellent dynamic water resistance.

The test in the Bally penetrometer (as per JUP10, Das Leder, 1961, 38 ff) produced the following values under 15% strain:

| | Water uptake after 6 hours | Water penetration |
|---|---|---|
| Leather after standard fatliquoring, without polysiloxane emulsion | 125% | after 3.5 min |
| Leather with polysiloxane emulsion | 9% | no water penetration after 6 hours |

Application Example b:

Wetblue leather pieces 1.8 mm in shaved thickness which have been neutralized as described in Example a are drummed for 30 minutes with 4% by weight of a commercially available hydrophobizing agent based on a paraffin emulsion and 2.5% by weight of the polysiloxane emulsion described in Example 4, each percentage being based on the shaved weight. They are then retanned with 8% by weight of a synthetic tanning agent based on a phenolsulfonic acid/formaldehyde condensate and dyed with 1% by weight of aniline dye, and the treatment liquor of 100% length is then soured off with formic acid to a pH of 4.0.

The pieces of leather are then drummed for 30 minutes in a fresh bath of 100% length with a further 2.5% by weight of the polysiloxane emulsion as specified in Example 4. The pieces of leather are soured off to a pH of 3.9 by a further 20 minutes of drumming, rinsed and made ready in a conventional manner.

The test in the Bally penetrometer under 15% strain produced the following values:

| | Water uptake after 6 hours | Water penetration |
|---|---|---|
| Leather only with paraffin emulsion | 62% | after 40 minutes |
| Leather with mixture of polysiloxane emulsion and paraffin emulsion | 12% | even after 6 h no water penetration |

Application Example c:

Pieces of wetblue leather neutralized to pH 6.5 and 1.1 mm in shaved thickness are dyed with 4% by weight of aniline dye and prefatliquored with 8% by weight of a commercially available hydrophobizing agent based on a paraffin emulsion and with 2.5% by weight of the polysiloxane emulsion described in Example 1 in the course of 45 minutes. They are retanned with 2% by weight of a polymer tanning agent based on acrylate and 4% by weight of a synthetic tanning agent based on a phenolsulfonic acid/formaldehyde condensate. They are then afterfatliquored with a further 6% by weight of a commercially available hydrophobizing agent based on a paraffin emulsion and 2.5% by weight of the polysiloxane emulsion specified in Example 1 in the course of 45 minutes, soured off to a pH of 3.8 and made ready in a conventional manner as described in Example a.

The test in the Bally penetrometer under 15% strain produced the following values:

| | Water uptake after 6 hours | Water penetration |
|---|---|---|
| Leather only with commercially available paraffin emulsion | 76% | after 25 minutes |
| Leather additionally with polysiloxane emulsion | 18% | even after 6 h no water penetration |

We claim:

1. A process for hydrophobizing leather, a pelt or a leather substitute material with a carboxyl-containing polysiloxane, which comprises treating the leather, pelt or leather substitute material before, during or after retanning with an aqueous liquor which contains a carboxyl-containing polysiloxane in the form of a salt selected from the group consisting of the alkali metal, amine and ammonium salts and has a pH of from 4.0 to 8.0, wherein the salts of the carboxyl-containing polysiloxane have been prepared by neutralizing a polysiloxane selected from the group consisting of the dimethylpolysiloxanes and the methylpropylpolysiloxanes having anhydride numbers of from 0.2 to 1.7 which has terminal carboxylic anhydride groups the salt of the carboxyl-containing polysiloxane being applied in an amount of from 0.1 to 15% by weight, based on the shaved weight of the leather or the wet weight of the pelt or leather substitute material, and then adjusting the pH to from 3.0 to 5.0.

2. A process as claimed in claim 1, wherein the polysiloxane which has terminal carboxylic anhydride groups has a viscosity of from 100 to 500 at 25° C.

3. A process as claimed in claim 1, wherein the neutralizing is effected by means of at least one base selected from the group consisting of sodium hydroxide, potassium hydroxide, ammonia, amines, alkanolamines and amino acids.

4. A process as claimed in claim 1, wherein the neutralizing is effected with morpholine.

5. A process as claimed in claim 1, wherein the neutralizing is effected with sarcosine.

6. A process as claimed in claim 1, wherein the subsequent pH adjustment is effected by adding formic acid.

* * * * *